US005499712A

United States Patent [19]

Harrelson

[11] Patent Number: 5,499,712

[45] Date of Patent: Mar. 19, 1996

[54] BASKET-STYLE CARRIER WITH NON-COLLAPSING END PANELS

[75] Inventor: Glen R. Harrelson, Rowell, Ga.

[73] Assignee: Riverwood International Corporation, Atlanta, Ga.

[21] Appl. No.: 325,137

[22] Filed: Oct. 20, 1994

[51] Int. Cl.[6] ..... B65D 5/46

[52] U.S. Cl. ..... 206/172; 206/162; 206/163

[58] Field of Search ..... 206/162, 163, 206/165, 170–172, 174, 175

[56] References Cited

U.S. PATENT DOCUMENTS

| | | | |
|---|---|---|---|
| 2,537,615 | 1/1951 | Arneson | 206/163 X |
| 3,402,872 | 9/1968 | Forrer | 206/170 X |
| 4,402,400 | 9/1983 | Stout | 206/162 |

FOREIGN PATENT DOCUMENTS

| | | | |
|---|---|---|---|
| 2418615 | 5/1975 | Germany | 206/162 |
| 186859 | 12/1963 | Sweden | 206/162 |

*Primary Examiner*—Bryon P. Gehman

[57] ABSTRACT

A basket-style carrier constructed so as to maintain the carrier open during loading. The end panels of the carrier are formed from overlapping end panel sections. Each end panel section is connected to a handle panel support by a fold line. The overlapping end panel section includes a wide portion that extends transversely beyond the fold line connecting it to the handle panel support. This causes the two sections to function as a unit, preventing the end panels from collapsing about their fold lines during loading. In addition, a bottom panel forming flap is connected to one of the end panel sections at each end of the carrier. This flap is adhered to the bottom panel flaps to tighten the construction.

28 Claims, 6 Drawing Sheets

BASKET-STYLE CARRIER WITH NON-COLLAPSING END PANELS

FIELD OF THE INVENTION

This invention relates to a basket-style carrier for carrying articles such as beverage bottles. More particularly, it relates to a basket-style carrier capable of maintaining an open square condition during loading of bottles or other articles and also capable of tightly fitting around the articles.

BACKGROUND OF THE INVENTION

Basket-style carriers are commonly employed to package beverage bottles. They include a separate cell for each bottle, from which the bottles can be readily removed, and a center handle partition. The carriers are fabricated from a blank which is folded and glued into collapsed carrier form, after which the collapsed carrier is erected. In one design the bottom panel is integrally formed so that when the collapsed carrier is erected bottles may be inserted down onto the bottom panel through the open cells. In another design the bottom panel is formed by connecting bottom panel flaps after the bottles have been inserted into the cells. The bottles are commonly inserted in this latter design by moving an opened carrier down over a group of stationary bottles, although the bottles may also be inserted by moving them down into the opened carrier.

In either case, to insert the bottles prior to forming the bottom panel the collapsed carrier must not only be opened to a square condition so as to permit entry of the bottles into the appropriate cells, but must be maintained in this condition until relative movement of the bottles into the carrier progresses to the point where the bottles themselves are capable of holding the carrier open. This is necessary because the end panels of a typical basket-style carrier include a vertical fold line aligned with the handle panel, which allows the end panels to be folded into collapsed condition. These end panel segments tend to fold back toward their original position after being initially opened, which misaligns the cells and bottles. To counter this tendency, elements of the packaging machine have been designed to initially maintain the carrier in open condition until the bottles are inserted to the point where they are able to hold the carrier open. This complicates the design of the packaging machine, however, and can be a limitation on the speed of the machine.

Another problem encountered in basket-style carriers is the difficulty of providing a tight fit between articles and the walls of the cell in which they are contained. When inserting articles into a carrier whose bottom panel has already been formed, the article-receiving cells must be large enough to readily permit entry of the articles. This necessarily results in a less than tight fit between the articles and the carrier. Although the ability to form the bottom panel after the articles have been inserted at least theoretically permits the bottom and side panels to be more tightly drawn about the articles, it is quite difficult to create a tight fit between the end panels and the articles.

It would be highly desirable to be able to maintain the erected carrier in open condition by means other than by packaging machine elements without complicating the carrier design or making it more expensive. It would also be desirable to be able to create a tight fit between the articles and all the panels of a basket-style carrier.

BRIEF SUMMARY OF THE INVENTION

The invention applies to any basket-style article carrier required to be held open during loading of articles until the articles enter the carrier cells a sufficient distance for themselves to be able to hold the carrier open. Such carriers are commonly comprised of opposite side panels connected to a bottom panel, a centrally located handle panel and means for supporting the handle panel which extend downwardly from and lie in substantially the same plane as the handle panel. The end panels are comprised of two end panel sections, each end panel section being foldably connected to one of the opposite side panels and to the handle panel support means along a handle panel support fold line.

One of the end panel sections of each end panel has a relatively wide portion extending transversely beyond the associated handle panel support fold line. The relatively wide portion overlaps and is adhered to the associated end panel section. The particular design of the handle panel support means and the means for dividing the carrier into a plurality of cells may vary as desired. For example, the handle panel support means may include two support panels in face-to-face relationship, each support panel being connected to an end panel section at opposite ends of the carrier, or it may be comprised of riser panels. Whatever specific design is employed, the construction of the end panels prevents the end panels from collapsing about the handle panel support fold lines and allows the carrier to remain open and square while articles are being inserted.

This arrangement is formed from a blank which consists of two substantially identical half-blank portions. Each half-blank portion includes an outer handle section which is connected to the outer handle section of the other half-blank portion by a central fold line, which results in each half-blank portion being in opposite reverse positions. Each half-blank portion is laid out so that an inner handle panel section is connected to the outer handle panel section, a handle panel support section is connected to the outer handle panel section, a second handle panel support section is located adjacent the inner handle panel section, end panel sections are connected to the handle panel support sections and a side panel section is connected to the two end panel sections.

In addition, it is preferred to provide a bottom panel forming flap at each end of the carrier. These flaps are connected to the end panels, extending into the interior of the carrier and being adhered to the bottom panel flaps to tighten the connection between the side, end and bottom panels. As described in more detail below, the flaps may be provided on one of the end panel sections which form the end panels.

These and other features and aspects of the invention will be readily ascertained from the detailed description of the preferred embodiments described below.

DETAILED DESCRIPTION OF THE PREFERRED EMBODIMENT

Figure 1:
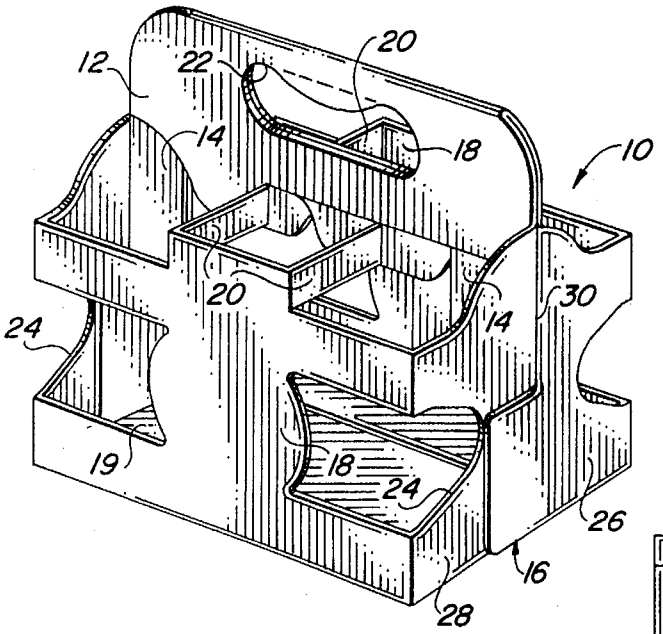
FIG. 1 is a pictorial view of a strap type of basket-style carrier incorporating the invention.

Referring to FIG. 1, the basket-style carrier 10 of the invention includes a central handle panel 12 connected to riser panels 14 which in turn are connected to end panels 16. The end panels are connected to side panels 18, and the side panels are connected to a bottom panel 19. Individual cells for receiving bottles or other articles are formed by straps 20 which extend from the side panels 18 to the handle panel 12. The handle panel includes a handle opening 22 and the carrier further includes corner cutouts 24 which extend into the adjacent side and end panels. This construction allows substantial portions of the end bottles in the carrier to be viewed, which is advantageous where the shape of the bottles contribute to brand identification.

Each end panel 16 is formed from two end panel flaps 26 and 28. The upper portions of the end panel flaps are connected by fold lines 30 to the adjacent riser panel 14 while the lower portion of the end panel flap 26 overlaps and is adhered to the lower portion of the end panel flap 28. This arrangement allows the carrier to remain open during loading as explained more fully below.

Figure 2:
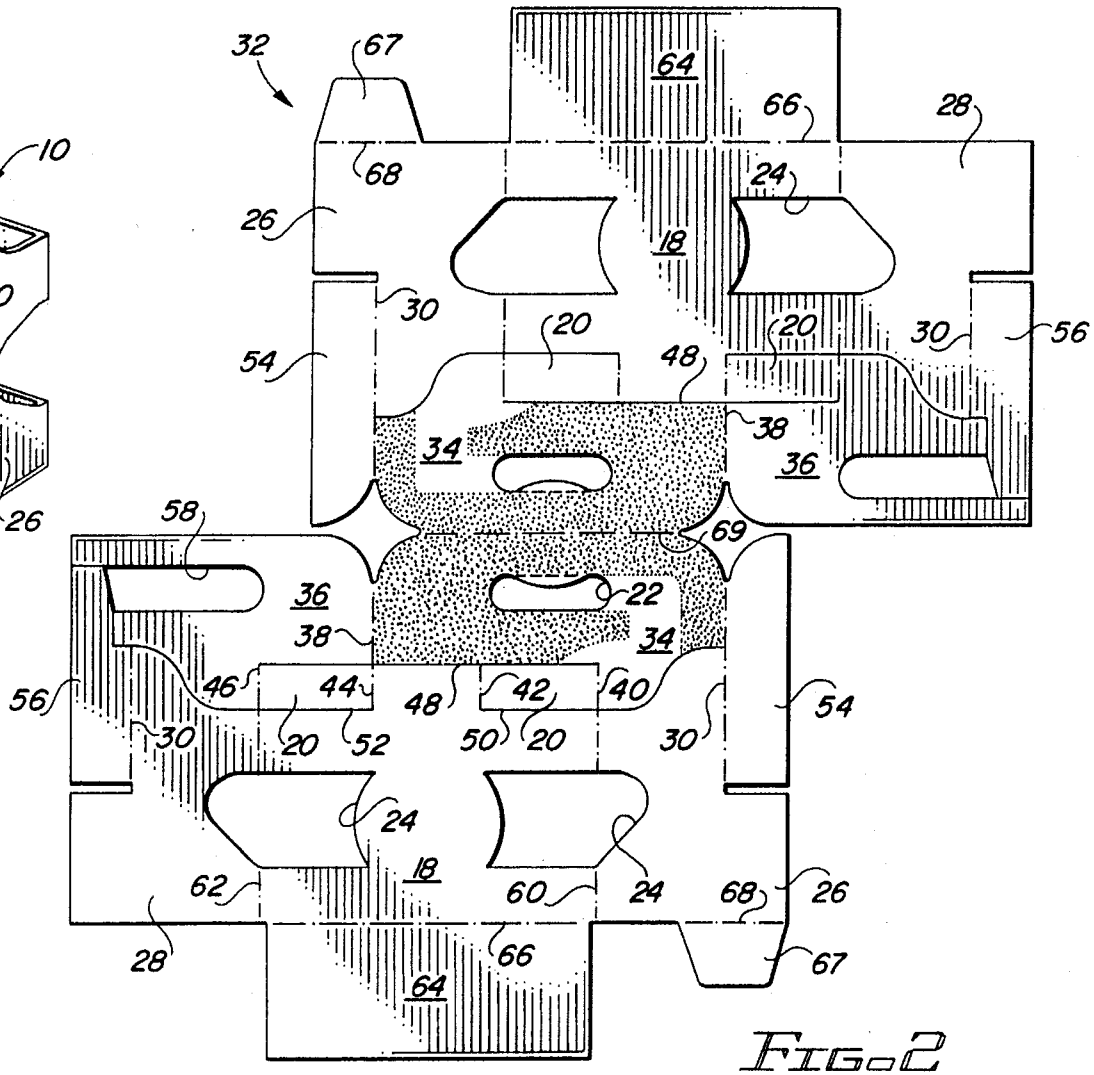
FIG. 2 is a plan view of a blank for fabricating the carrier of FIG. 1.

Referring to FIG. 2, wherein like reference numerals to those used in FIG. 1 denote like elements, a blank 32 for forming the carrier is shown. Preferably, the blank is formed from paperboard of the type conventionally used in the carrier industry. Basically, the blank is comprised of two half-blank portions, each being substantially identical but located so as to be in opposite reverse positions, resulting in the halves of the blank being offset from each other. Each half includes an outer handle panel section 34 connected to an inner handle panel section 36 by fold line 38. One of the cell dividing straps 20 in each half of the blank is connected at one end by fold line 40 to the outer handle panel section 34 and at the other end by fold line 42 to the side panel section 18. The other cell dividing strap 20 is connected at one end by fold line 44 to the side panel section 18 and at the other end by fold line 46 to the inner handle panel section 36. A slit 48 extending between the ends of the fold lines 40 and 46 separates the straps 20 from the inner and outer handle panel sections 34 and 36, and also separates the inner handle panel section 34 from the side panel section 18. A slit 50 extends from the outer end of the fold line 42 along a straight path to separate one of the cell dividing straps 20 from the side panel section 18, while another slit 52 extends from the outer end of the fold line 44 along a straight path to separate the other cell dividing strap 20 from the side panel section 18. The slit 50 includes an arcuate portion which separates the outer handle panel section 34 from the end panel flap 26, while the slit 52 includes an arcuate portion which separates the inner handle section 36 from the end panel flap 28. The slit 50 terminates at the fold line 30 of riser panel flap 54, while the slit 52 terminates slightly past the fold line 30 of riser panel flap 56. The inner handle panel section 36 is open ended, forming cutout 58 in the inner handle panel section.

Fold line 60, which is interrupted by a cutout 24, connects the end panel flap 26 to one end of the side panel section 18 while fold line 62, which is similarly interrupted by a cutout 24, connects the end panel flap 28 to the opposite end of the side panel section 18. Fold line 46 is a continuation of fold line 62. Similarly, fold line 40 is a continuation of fold line 60. A bottom panel flap 64 is connected to each side panel section 18 by fold line 66, which is aligned with the outer edges of the end panel flaps 26 and 28. In addition, a bottom panel forming tab or flap 67 is connected to the outer portion of each end panel flap 26 by fold line 68 for a purpose explained below. The outer handle panel sections 34 are connected to each other by central fold line 69.

Figure 3:
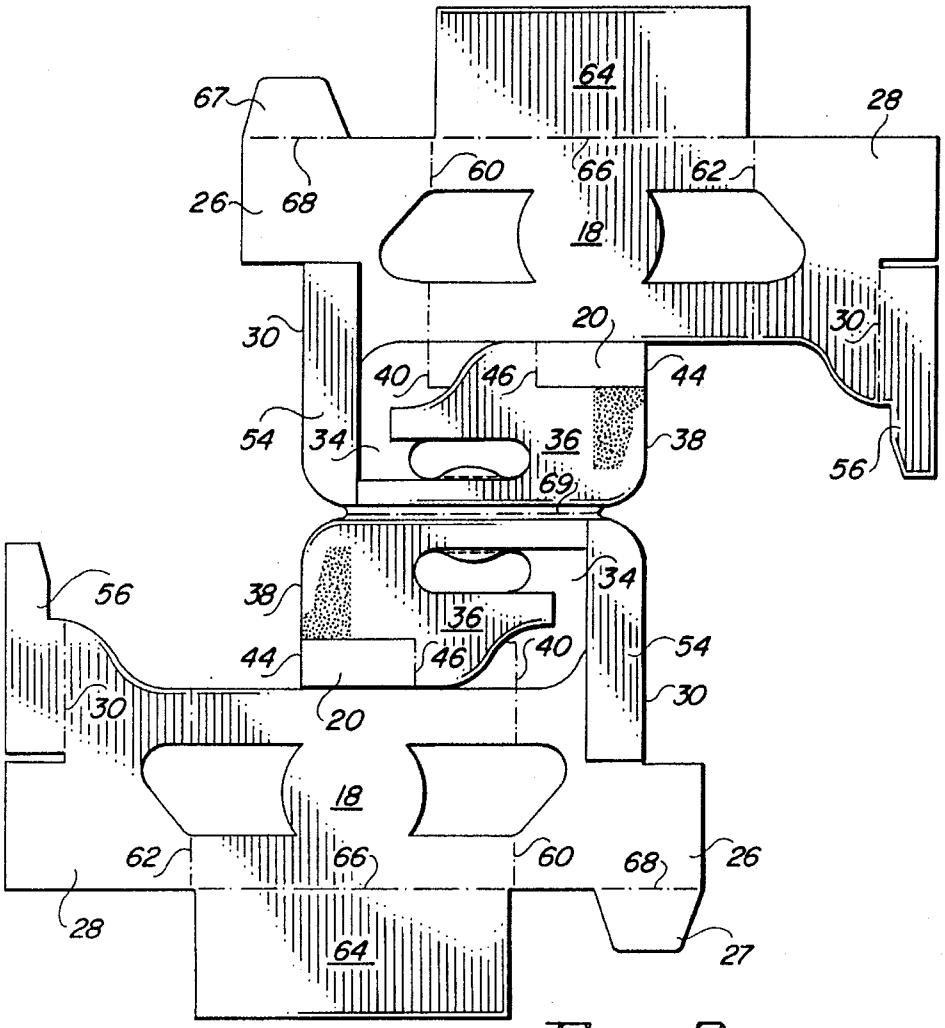
FIG. 3 is a plan view of the carrier blank after an initial series of folding steps.

To form a carrier from the blank the outer handle panel sections 34 are coated with adhesive, as shown in stipple in FIG. 2, and both the inner handle panel sections 36 and the riser panel flaps 54 are pivoted about their fold lines 38 and 30, respectively, onto the outer handle panel section 34 to the position illustrated in FIG. 3. The next step is to apply adhesive to the areas of the inner handle panel sections 36 shown in stipple in FIG. 3, and then fold the end panel sections 28 about the fold lines 62 so that the connected riser panel flaps 56 are adhered to the inner handle panel sections. This produces the interim form of blank shown in FIG. 4.

Figure 4:
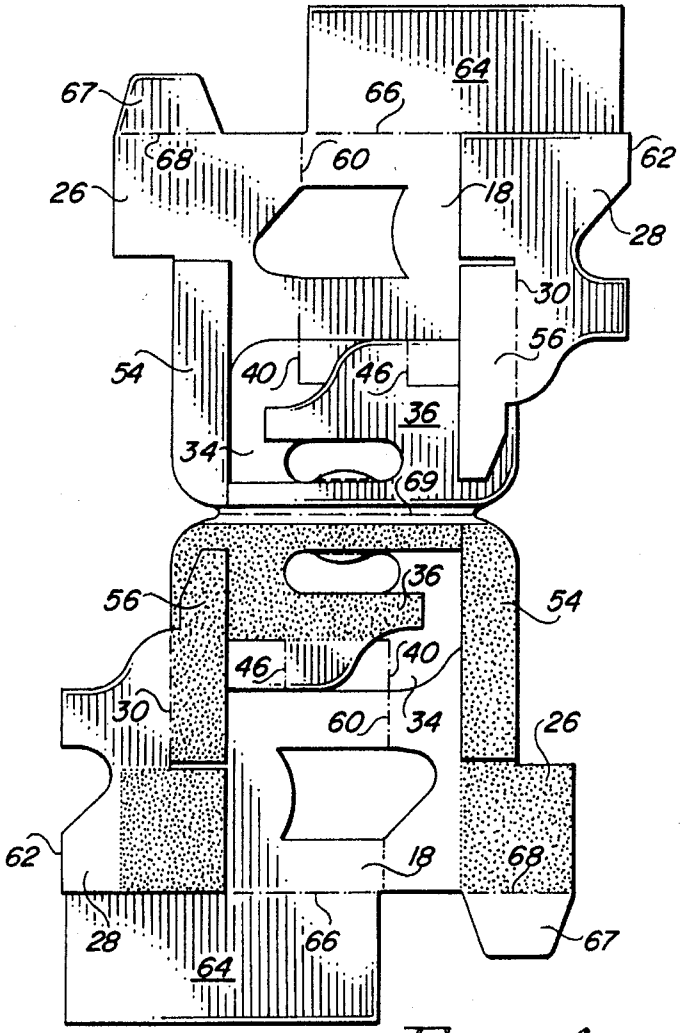
FIG. 4 is a plan view of the carrier blank after a second series of folding steps.

The final step is to apply adhesive to the stippled areas of FIG. 4, which includes one of the inner handle panel sections 36, the adjacent riser panel flaps 54 and 56 and a portion of the associated end panel flap 28. The blank is then folded about the fold line 69, producing the collapsed carrier illustrated in FIG. 5. The end panel formed from the end panel flaps 26 and 28 at the left of the blank is coextensive with the uppermost side panel section and the end panel formed from the partially hidden end panel flap 28 at the right of the blank is coextensive with the lowermost side panel section.

Figure 5:
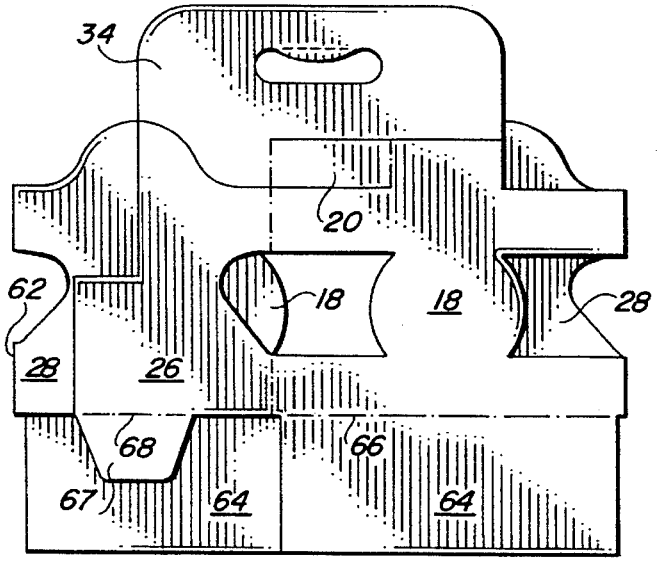
FIG. 5 is a plan view of a collapsed carrier resulting from a final folding step.
Figure 6:
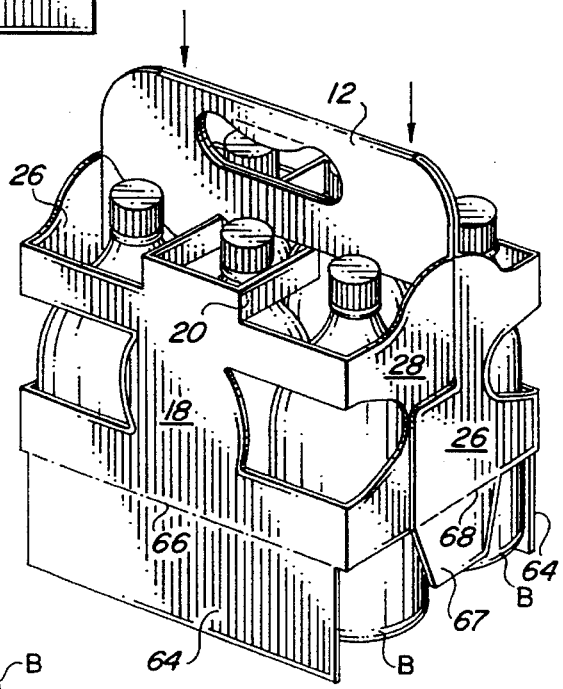
FIG. 6 is a pictorial view of an erected carrier in the process of being moved down over a group of bottles.
Figure 7:
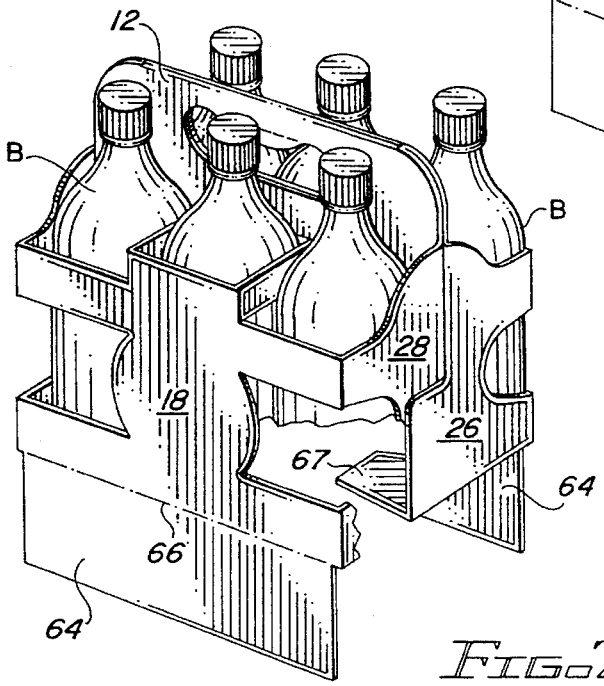
FIG. 7 is a pictorial view of the erected carrier of FIG. 6, with portions of the structure removed in order to illustrate a detail of the bottom panel forming process, after the carrier has been moved to its final position relative to the packaged bottles and just prior to forming the bottom panel.
Figure 8:
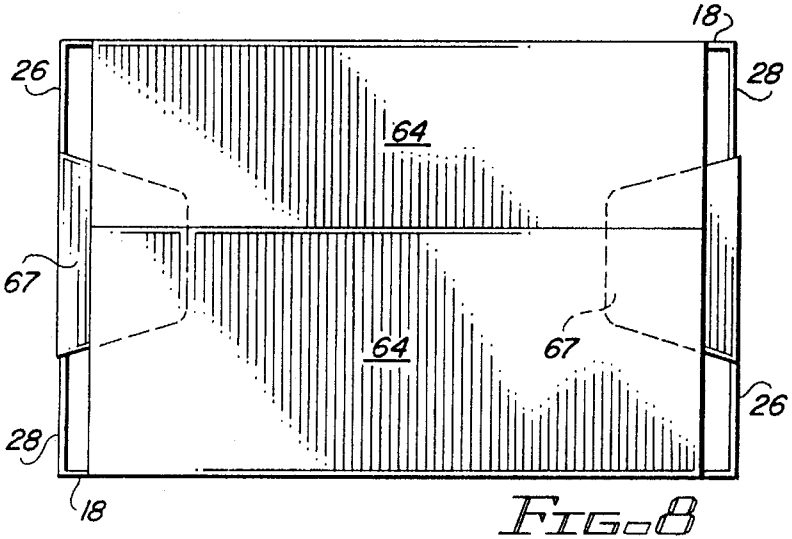
FIG. 8 is a bottom plan view of a fully formed carrier, with the hidden portions of the bottom panel tabs shown in dotted lines.

To form a loaded carrier from the collapsed carrier of FIG. 5, the collapsed carrier is squared up by applying inward pressure to the outer ends of the side panel sections. The opened carrier is then aligned with a group of bottles to be packaged and lowered down over them, as illustrated in FIG. 6. During this step the bottom panel flaps 64 and the bottom panel forming flaps 67 remain unfolded. After the carrier reaches it final position relative to the bottles, the forming flaps 67 are folded in about the fold lines 68 to bring them up against the bottoms of the bottles. One of the folded forming flaps is shown in FIG. 7, in which part of the near corner bottle B and part of the end panel flap 28 have been removed in order to expose the forming flap. The bottom panel flaps are then overlapped and adhered to each other and to the forming flaps 67, as by glue, to form the bottom panel of the carrier. The resulting bottom panel is illustrated in FIG. 8.

Because the portions of the end panel flaps located beneath the riser panels overlap each other and are not foldably connected, the end panels remain straight and do not collapse as the bottles are inserted into the cells. As a result there is no tendency for the carrier as a whole to fold back to its collapsed condition even when the squaring-up force is withdrawn. The carrier thus remains in an open erected condition with the cells open to receive bottles during loading. Of course the carrier could be opened as described and bottles loaded into it by lowering them down into the cells instead of lowering the carrier down over the bottles. In either case the end panels remain flat and provide a stiffening effect which does not promote collapsing of the carrier while the bottles are loaded, and the initial entry of the bottles into the cells also acts to form the carrier into its final condition.

It will be appreciated that the layout of the blank, in which identical halves are in opposite reversed positions, enables the end panel flaps to be connected in overlapping fashion in order to create a collapsed carrier having flat, stiff end panels which do not themselves have a tendency to collapse.

The provision of the bottom panel forming flaps 67 further makes it possible to tightly form the carrier about the bottles. As a result of the bottom panel flaps being adhered to the forming flaps 67, the side panels, by virtue of their integral connection to the bottom panel flaps, and the end panels, by virtue of their integral connection to the bottom panel forming flaps, are directly linked to the bottom panel. Thus the side panels, the end panels and the bottom panel are locked into place as a unit after the bottom panel flaps and the bottom panel forming flaps are moved into place, causing the bottles about which the bottom panel is formed to be tightly held in place.

Note that the bottom panel forming flaps 67 are connected to the overlapping end panel flaps 26. This is a preferred arrangement because the adherence of the forming flaps to the bottom panel flaps prevents the outer end panel flaps 26 from moving outwardly away from each other in response to forces within the carrier. Since the end panel flaps 26 overlap the inner end panel flaps 28, these latter flaps are automatically protected against outward movement. Although it is possible to connect the bottom panel forming flaps 67 to the inner end panel flaps 28 to successfully achieve the benefits of the integrated construction discussed above, in such an arrangement the outer end panel flaps 26 would be protected against outward forces only to the extent of the strength of the glue bond between the inner and outer end panel flaps.

The invention is not limited to the strap type of basket-style carrier described in connection with FIGS. 1–8, but is applicable to other types of basket-style carriers as well. The basket-style carrier 70 of FIG. 9, for example, is of the type that affords full protection to the contents along the side and end panels. The carrier includes a central handle panel 72 connected at opposite ends to handle panel support panels 73 and riser panels 74. End panels 76 are comprised of end panel flaps 78 and 80, which are overlapped at their lower portions as in the first embodiment and which are connected by fold lines to the riser panels and central handle support panels as explained in more detail below. The end panels are connected to side panels 82, and the side panels are connected to a bottom panel which is not visible in this view. Individual cells for receiving bottles or other articles are formed by dividers 84 and 86 which extend from the side panels 82 to the central handle support panels 73.

Figure 9:
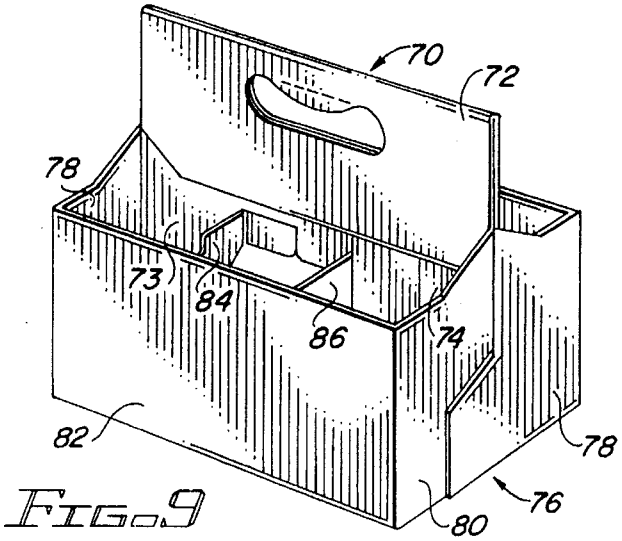
FIG. 9 is a pictorial view of another type of basket-style carrier incorporating the invention.
Figure 10:
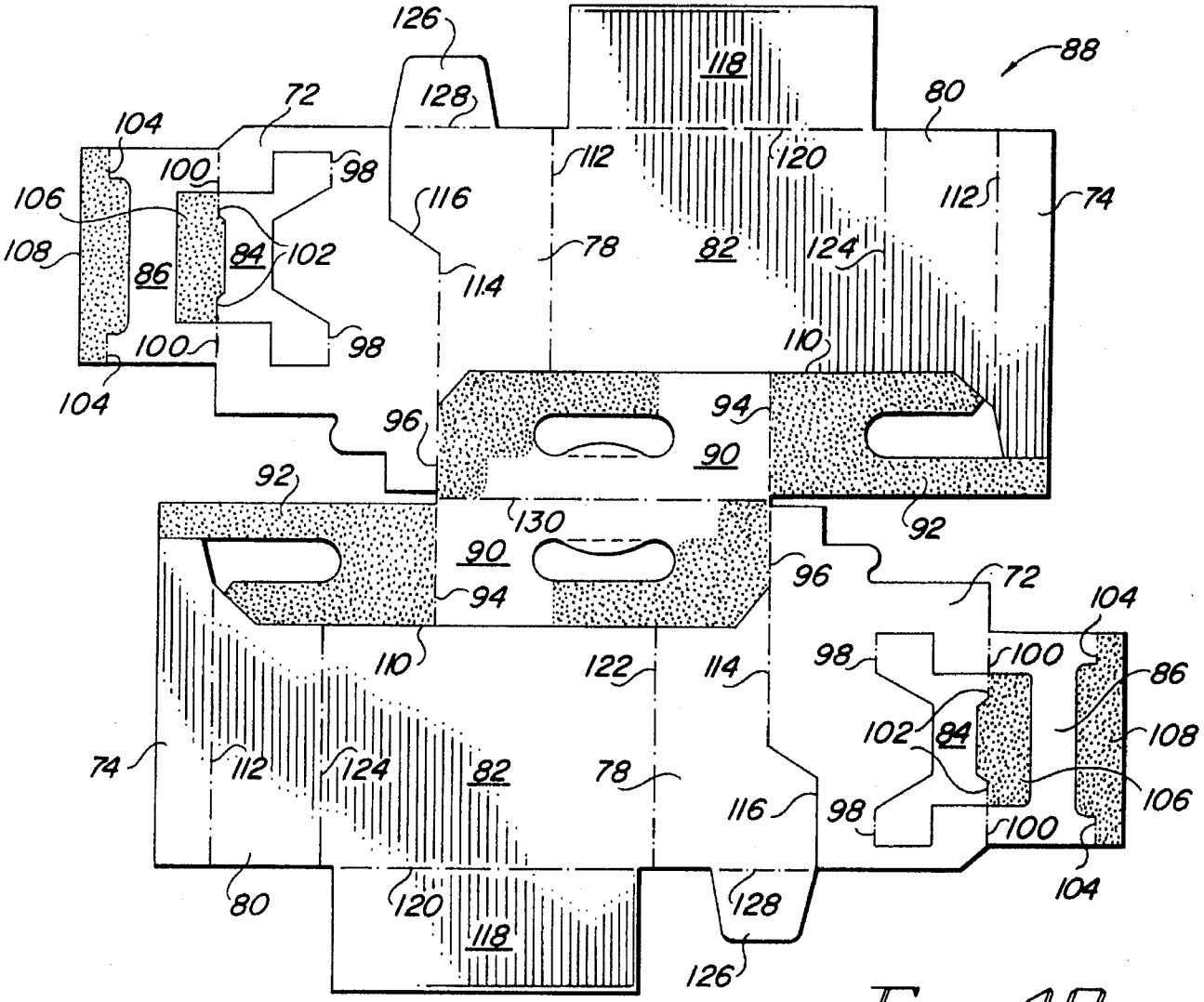
FIG. 10 is a plan view of a blank for fabricating the carrier of FIG. 9.

Referring to FIG. 10, wherein like reference numerals to those used in FIG. 9 denote like elements, a blank 88 for forming the carrier is shown. As in the first embodiment, the blank preferably is formed from paperboard of the type conventionally used in the carrier industry and is comprised of two halves, each being substantially identical but located so as to be in opposite reverse positions. Each half includes an outer handle panel section 90 connected to an inner handle panel section 92 by fold line 94. At the end of the outer handle panel section 90 opposite the fold line 94 is a fold line 96 which connects the outer handle panel section to the central divider panel section 72. The cell dividers 84 and 86 are connected by interrupted fold lines 98 and 100, respectively, to the central divider panel section 72 and by interrupted fold lines 102 and 104 to glue flaps 106 and 108. The solid lines which define the cell dividers represent slits which separate the dividers from the central divider panel section, as is well known in the art.

A slit 110, defining edges of the inner and outer handle panel sections, separates the handle panel sections from the side panel section 82 and from the end panel flaps 78 and 80. The slit 110 terminates at one end at fold line 112, which connects the riser panel flap 74 to the end panel flap 80, and at the other end at the fold line 96. Fold line 114, which is a continuation of fold line 96, connects the end panel flap 78 to the central divider panel section 72. The fold line 114 terminates at the slit 116, which includes a transverse portion and a straight portion. The width of the end panel flap 78 at its lower portion, which is the distance from the fold line 122 to the slit 116, is greater than at its upper portion, as defined by the distance from the fold line 112 to the fold line 114. The side panel section 82 is connected to a bottom panel flap 118 along fold line 120, and to the end panel flaps 78 and 80 along the fold lines 122 and 124, respectively. As in the first embodiment, a bottom panel forming tab or flap 126 is connected to the outer portion of each end panel flap 78 by fold line 128. The outer handle sections 90 of each half of the blank are connected to each other by the central fold line 130.

To form a carrier from the blank 88 the outer handle panel sections 90, the inner handle panel sections 92 and the glue flaps 106 and 108 of the dividers are coated with adhesive, as shown in FIG. 10 in stipple. The divider panel sections 72 are then pivoted in about the fold lines 96 and 114 to cause them to be adhered to the outer handle panel sections 90 and the divider glue flaps to be adhered to the side panel sections 82. The inner handle panel sections 92 are then pivoted about their fold lines 94 to cause them to be adhered to the folded central divider panel sections 72 and the folded outer handle panel sections 90. The partially folded blank at this point appears as illustrated in FIG. 11.

Figure 11:
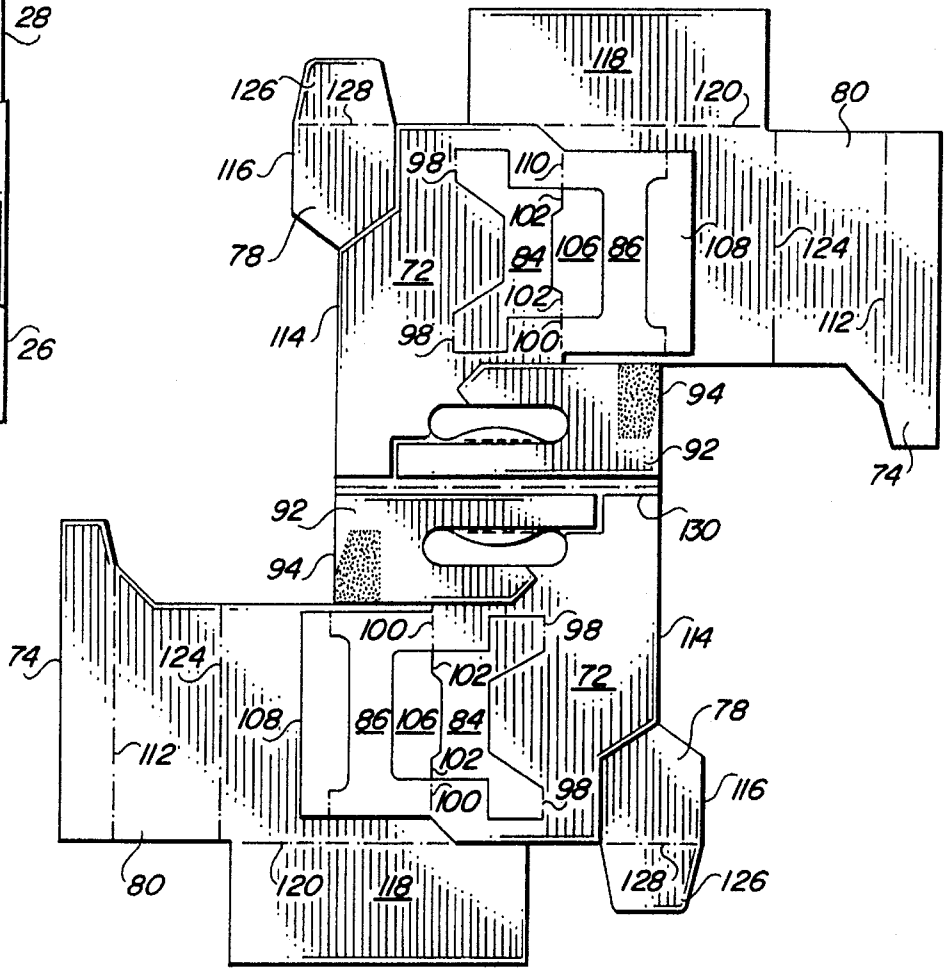
FIG. 11 is a plan view of the carrier blank of FIG. 10 after an initial series of folding steps.
Figure 12:
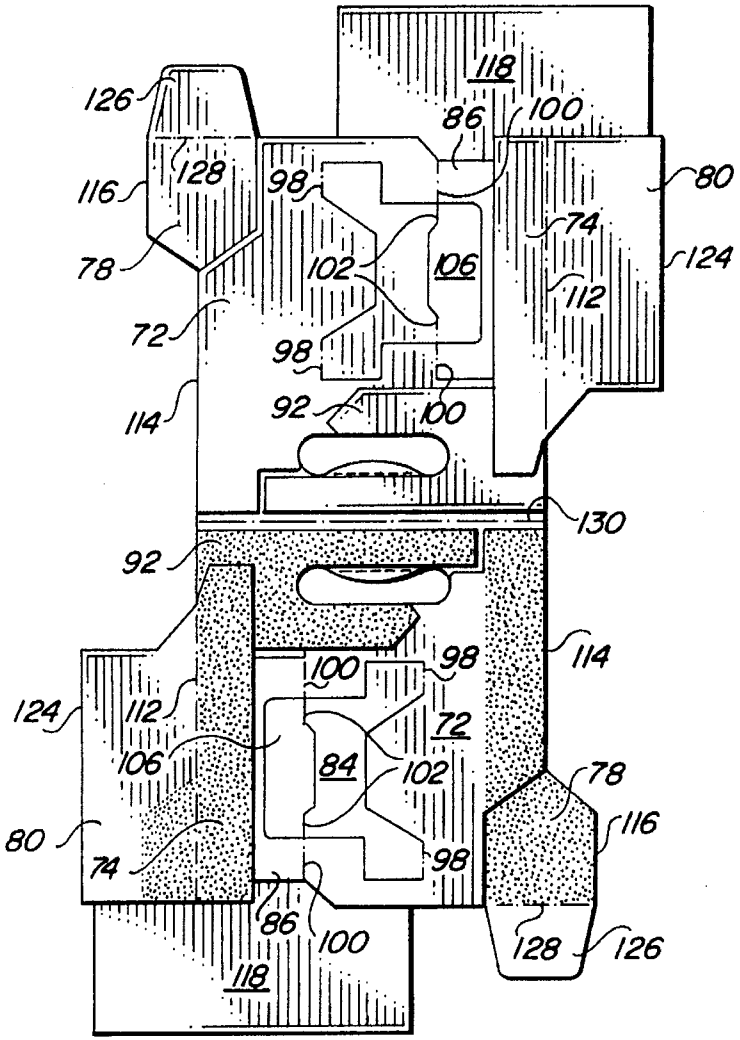
FIG. 12 is a plan view of the carrier blank of FIG. 10 after a second series of folding steps.

The next step is to apply adhesive to the areas of the inner handle panel sections 92 shown in stipple in FIG. 11, then fold the end panel sections 80 about the fold lines 124 so that the upper portions of the connected riser panel flaps 74 are adhered to the inner handle panel sections. This produces the interim form of blank shown in FIG. 12.

The final step is to apply adhesive to the stippled areas of one of the inner handle panel sections 92, the adjacent riser panel flap 74, a portion of the associated end panel flap 80, a portion of the divider panel section 72 and the exposed wide portion of the end panel section 78. The blank is then folded about the fold line 130, producing the collapsed carrier illustrated in FIG. 13. As in the collapsed carrier of the first embodiment, the end panel formed from the end panel flap 80 and the end panel section 78 at the left of the blank is coextensive with the uppermost side panel section and the end panel formed from the end panel flap and end panel section at the right of the blank is coextensive with the lowermost side panel section.

Figure 13:
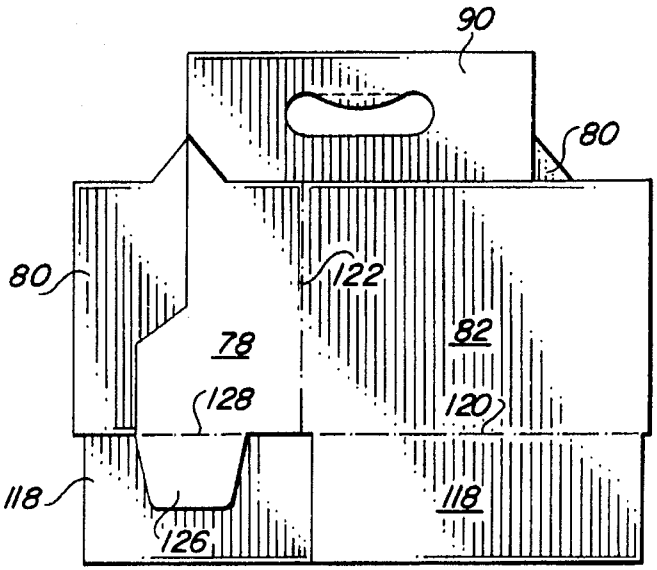
FIG. 13 is a plan view of a collapsed carrier resulting from a final folding step of the blank of FIG. 10.

A loaded carrier is formed from the collapsed carrier of FIG. 13 as described in connection with the collapsed carrier of FIG. 5 and the forming steps of FIGS. 6 and 7. The bottom panel of the carrier is similar to the bottom panel illustrated in FIG. 8. Because the wide portions of the end panel sections 78 overlap and are adhered to the end panel flaps 80 beneath the point at which the end panel sections 78 are foldably connected to the central divider panel sections along fold lines 114, the overlapped portions are not foldably connected and remain straight, thereby preventing collapse of the carrier.

As in the first embodiment, the layout of the blank, in which identical halves are in opposite reversed positions, enables the end panel flaps to be connected in overlapping fashion in order to create a collapsed carrier having the type of flat, stiff end panels which do not themselves have a tendency to collapse.

The bottom panel forming flaps 126 allow the carrier to be tightly formed about the bottles as in the first embodiment. In this embodiment it is required that the bottom panel forming flaps be connected to the overlapping end panel flaps 78. If the bottom panel forming flaps were connected to the proper location of the end panel flaps 80, part of the flap would be aligned with the fold line 112. Since the fold line 112 extends the full length of the end panel flap 80, when the riser panel flap 74 is folded into place the bottom panel forming flap would interfere with this process.

It should now be appreciated that the end panel construction of both of the described basket-style carrier embodiments permits the carrier to maintain its square open loading condition without aid from elements of the packaging machine to overcome a longstanding problem in a simple, economical, yet highly efficient manner, and the unique layout of the carrier blank permits the ready formation of the desired end panel structure. Further, the provision of bottom panel forming flaps enables the carrier to be tightly formed while including the end panels in the integrally connected arrangement.

It will be apparent that although the invention has been described in connection with a carrier designed for holding bottles, it applies equally as well to carriers designed to hold other types of articles instead. It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A basket-style article carrier, comprising:

opposite side panels connected to a bottom panel;

a centrally located handle panel;

means for supporting the handle panel, said means extending downwardly from and lying in substantially the same plane as the handle panel;

opposite end panels connected to the side panels, each end panel being comprised of two end panel sections, each end panel section being foldably connected to one of the opposite side panels;

each end panel section being connected to the handle panel support means along a handle panel support fold line;

one of the end panel sections of each end panel having a portion extending transversely beyond the handle panel support fold line thereof, each transversely extending portion overlapping and being adhered to the associated end panel section, whereby the end panels formed from the overlapping end panel sections cannot collapse about the handle panel support fold lines.

2. A basket-style article carrier as defined in claim 1, including means for dividing the carrier into a plurality of cells of receiving articles.

3. A basket-style article carrier as defined in claim 2, wherein the handle panel support means includes two support panels in face-to-face relationship, each support panel being connected to an end panel section at opposite ends of the carrier, and wherein the means for dividing the carrier into a plurality of cells includes at least one partition extending transversely from each support panel.

4. A basket-style article carrier as defined in claim 2, wherein the means for dividing the carrier into a plurality of cells includes at least one partition extending transversely from each side panel to the handle panel.

5. A basket-style article carrier as defined in claim 4, wherein the handle panel support means comprises two riser panels at each end of the carrier, each riser panel being connected to one of the end panel sections.

6. A basket-style article carrier as defined in claim 1, wherein the handle panel support means comprises at least one riser panel at each end of the carrier.

7. A basket-style article carrier as defined in claim 1, wherein the handle panel support fold line of each of said one end panel support sections terminates above the transversely extending portion thereof.

8. A basket-style article carrier as defined in claim 1, including a bottom panel forming flap connected along a fold line to one of the end panel sections of each end panel, the bottom panel forming flaps being adhered to the bottom panel.

9. A basket-style article carrier as defined in claim 8, wherein the bottom panel forming flaps are connected to the overlapping end panel sections.

10. A basket-style article carrier as defined in claim 9, wherein the bottom panel forming flaps are located substantially centrally of the end panels.

11. A basket-style article carrier as defined in claim 8, wherein the bottom panel is comprised of at least one bottom panel flap connected by a fold line to one of the side panels.

12. A basket-style article carrier as defined in claim 11, wherein the bottom panel is comprised of two bottom panel flaps each connected to one said opposite side panel by a fold line.

13. A collapsed basket-style article carrier, comprising:

opposite side panels having end edges;

at least one of the side panels having a bottom panel flap connected thereto;

an end panel section connected to each end edge of each side panel along a fold line, associated end panel sections being adhered to each other to form opposite end panels;

each end panel lying in substantially the same plane as one of the side panels;

a handle panel;

means for supporting the handle panel, said means lying in substantially the same plane as the handle panel;

each end panel section being connected to the handle panel support means along a handle panel support fold line;

one of the end panel sections of each end panel having a portion extending transversely beyond the handle panel support fold line thereof, the transversely extending portion overlapping the associated end panel section, whereby the end panels formed from the overlapping end panel sections cannot collapse about the handle panel support fold lines.

14. A collapsed basket-style article carrier as defined in claim 13, including means for dividing the carrier into a plurality of cells for receiving articles.

15. A collapsed basket-style article carrier as defined in claim 14, wherein the handle panel support means includes two support panels in face-to-face relationship, each support panel being connected to an end panel section at opposite ends of the carrier, and wherein the means for dividing the carrier into a plurality of cells includes at least one partition foldably connected to each support panel.

16. A collapsed basket-style article carrier as defined in claim 14, wherein the means for dividing the carrier into a plurality of cells includes at least one partition foldably connected to opposite sides of the handle panel.

17. A collapsed basket-style article carrier as defined in claim 16, wherein the handle panel support means comprises two riser panels at each end of the carrier, each riser panel being connected to one of the end panel sections.

18. A collapsed basket-style article carrier as defined in claim 13, wherein the handle panel support means comprises at least one riser panel at each end of the carrier.

19. A collapsed basket-style article carrier as defined in claim 13, wherein the handle panel support fold line of each of said one end panel support sections terminates above the transversely extending portion thereof.

20. A collapsed basket-style article carrier as defined in claim 13, including a bottom panel forming flap connected to and extending downwardly from one of the end panel sections of each end panel.

21. A collapsed basket-style article carrier as defined in claim 20, wherein the bottom panel forming flaps are connected to the overlapping end panel sections.

22. A collapsed basket-style article carrier as defined in claim 21, wherein the bottom panel forming flaps are located substantially centrally of the end panels.

23. A collapsed basket-style article carrier as defined in claim 20, wherein there are two bottom panel flaps, each being connected to an opposite side panel.

24. A blank for forming a basket-style carrier, comprising:

two substantially identical half-blank portions;

each half-blank portion .including an outer handle panel section connected to the outer handle panel section of the other half-blank portion by a central fold line;

each outer handle panel section having opposite end edges extending substantially at right angles to the central fold line and a lower edge extending transversely of the end edges;

an inner handle panel section connected by a fold line to one of the end edges of each of the outer handle panel sections;

a first handle panel support section connected by fold line to the opposite end edge of each of the outer handle panel sections;

a first end panel section adjacent a portion of each of the outer handle panel sections and being connected by fold line to the associated first handle panel support section;

a side panel section adjacent portions of each of the outer handle panel sections and the associated inner handle panel section, the side panel section being connected by a first fold line to the first end panel section;

a second end panel section adjacent a portion of the inner handle panel section and being connected by a second fold line to the side panel section;

a second handle panel support section connected by fold line to the second end panel section; and the side panel section of at least one of the half-blank portions having a bottom panel flap connected thereto by a fold line;

a portion of one of the end panel sections in each half-blank portion being dimensioned to overlap a portion of the other end panel section in the other half-blank portion in a carrier formed from the blank.

25. A carrier blank as defined in claim 24, wherein the end panel section which overlaps the other end panel section is the first end panel section of each half-blank portion.

26. A carrier blank as defined in claim 24, wherein one of the end panel sections of each half-blank portion includes a bottom panel forming flap extending away from the central fold line.

27. A carrier blank as defined in claim 26, wherein said one end panel section of each half-blank portion is said first end panel section and the bottom panel forming flap is connected by fold line to said one end panel section.

28. A carrier blank as defined in claim 24, including means for dividing a carrier formed from the blank into a plurality of cells, said means being connected to each half-blank portion by fold lines.

* * * * *